US008960319B2

(12) United States Patent
Orr et al.

(10) Patent No.: US 8,960,319 B2
(45) Date of Patent: Feb. 24, 2015

(54) FLAT PLATE CONCEALED HORIZONTAL SIDEWALL SPRINKLER

(75) Inventors: Shawn G. Orr, Grand Rapids, MI (US); Scott A. English, Nashville, MI (US)

(73) Assignee: The Viking Corporation, Hasting, MI (US)

( * ) Notice: Subject to any disclaimer, the term of this patent is extended or adjusted under 35 U.S.C. 154(b) by 880 days.

(21) Appl. No.: 13/165,531

(22) Filed: Jun. 21, 2011

(65) Prior Publication Data

US 2012/0024547 A1 Feb. 2, 2012

Related U.S. Application Data

(60) Provisional application No. 61/368,479, filed on Jul. 28, 2010.

(51) Int. Cl.

| | |
|---|---|
| ***A62C 37/08*** | (2006.01) |
| ***A62C 37/09*** | (2006.01) |
| ***A62C 37/12*** | (2006.01) |

(52) U.S. Cl.

CPC ..... *A62C 37/09* (2013.01); *A62C 37/12* (2013.01)

USPC ..... 169/37; 169/16; 169/41; 169/57; 239/500; 239/502; 239/504; 239/521; 239/522

(58) Field of Classification Search

CPC ..... A62C 35/605; A62C 35/58; A62C 37/10; A62C 37/14; A62C 37/12; A62C 37/09; A62C 3/00; A62C 31/005; A62C 31/02; B05B 1/265; B05B 1/262; B05B 1/267; B05B 15/10

USPC ..... 169/16, 37, 41, 56, 57; 239/500, 502, 239/504, 518, 521–524

See application file for complete search history.

(56) References Cited

U.S. PATENT DOCUMENTS

| | | | | |
|---|---|---|---|---|
| 4,618,001 | A | 10/1986 | Hoening | |
| 6,123,153 | A * | 9/2000 | Finnegan | 169/37 |
| 6,152,236 | A | 11/2000 | Retzloff et al. | |
| 6,367,559 | B1 * | 4/2002 | Winebrenner | 239/502 |
| 6,520,265 | B2 | 2/2003 | Winebrenner | |
| 7,275,603 | B2 * | 10/2007 | Polan | 169/41 |
| 2002/0129946 | A1 | 9/2002 | Retzloff et al. | |
| 2006/0219817 | A1 | 10/2006 | Franson et al. | |
| 2009/0255693 | A1 | 10/2009 | Sato et al. | |

FOREIGN PATENT DOCUMENTS

CA 2348044 A1 11/2001

OTHER PUBLICATIONS

Viking, Technical Data, "Quick Response Concealed Horizontal Sidewall Sprinkler"; Form No. F_010301; Sprinkler 63a; Sep. 14, 2001 (4 pages).

* cited by examiner

*Primary Examiner* — Steven J Ganey

(74) *Attorney, Agent, or Firm* — Harness, Dickey & Pierce, P.L.C.

(57) ABSTRACT

A sprinkler assembly having a base including a passageway, an inlet opening communicating with a pressurized fluid source, an outlet opening for outputting a flow of pressurized fluid along a flow path, and an axis extending through the outlet opening. The sprinkler assembly further comprises a top engaging the base and a deployment assembly supporting a flow shaper assembly. The deployment assembly is movably mounted to either the base or the top and is movable horizontally between a retracted position and an extended position for dispersing the pressurized fluid from the outlet opening. A heat responsive trigger is mounted to releasably retain the deployment assembly within the retracted position.

28 Claims, 10 Drawing Sheets

FLAT PLATE CONCEALED HORIZONTAL SIDEWALL SPRINKLER

CROSS-REFERENCE TO RELATED APPLICATIONS

This application claims the benefit of U.S. Provisional Application No. 61/368,479, filed on Jul. 28, 2010. The entire disclosure of the above application is incorporated herein by reference.

FIELD

The present disclosure relates to a sprinkler assembly and, more particularly, to a concealed horizontal sprinkler assembly for use in a side wall mount having a flat plate cover assembly useful in both residential and commercial sprinkler systems.

BACKGROUND

This section provides background information related to the present disclosure which is not necessarily prior art.

Automatic sprinklers are well known and have long been used in fire extinguishing systems. Typically, automatic sprinkler assemblies include a sprinkler body which includes an inlet for connecting to a pressurized supply of water or other fire extinguishing fluid, an outlet opening, and a deflector which is mounted spaced from the outlet opening of the sprinkler body. The deflector disperses and directs the water in an optimum pattern when the water is discharged through the outlet opening. In one common form, the deflector is mounted in a fixed position and spaced from the outlet opening by a frame. The frame includes a pair of arms, which attach to either side of the sprinkler body, and aligns the deflector with the path of the water when it is discharged through the outlet opening. The outlet opening is normally closed by a closure seal which is held in place typically by a trigger element, such as a glass bulb or a fusible link element. The trigger element extends between the seal and the frame and is usually held in place by a set screw or the like.

Other forms of sprinkler assemblies include flush sprinkler assemblies. Flush sprinkler assemblies include a housing and a deflector which is recessed within the housing. The deflector is movably mounted to the sprinkler body by a pair of guide members and moves between a closed position in which the deflector is recessed within the housing and an extended position wherein the deflector projects from the housing and is spaced from the outlet opening of the sprinkler body. Since the deflector is supported only by two guide members, the deflector can experience instability or rotation about the axis extending between the two guide members. Similar to a fixed sprinkler assembly, a flush sprinkler assembly includes a thermally responsive trigger mechanism and a fluid seal. In a flush sprinkler, the fluid seal is positioned within the interior of the sprinkler body and is maintained in a closed position by a pair of pins or actuators. The pins are inwardly biased by the trigger mechanism. Thus, under normal operating conditions, the trigger mechanism prohibits fluid flow from the outlet of sprinkler body. When the temperature rises to a preselected value, the trigger mechanism, which is normally a fusible link, separates permitting the pins to move in an outward direction under the pressure of the water. With the separation of the fusible link, the pressure in the water supply line pushes the fluid seal away from the outlet opening and the deflector to its outward position thereby enabling the water to travel through the sprinkler body and to be dispersed by the deflector.

In side wall mounted sprinklers, however, the ejection of the trigger assembly may slow the release of the deflector from within the housing of the flush sprinkler assembly. Additionally, the orientation of the assembly causes the pressurized water to disperse in a horizontal direction. While attempts have been made to redirect the flow of the water downwardly by adding a blade to the deflector, heretofore these side wall sprinklers have not produced an optimal spray pattern. Nor are they suitable for flush mounted arrangements since they do not permit the deflector to be fully recessed within the sprinkler base. Consequently, there is a need for a flush side wall sprinkler assembly which offers improved ejection of the trigger assembly from the sprinkler assembly when the trigger is activated. Furthermore, there is a need for an automatic side wall sprinkler assembly which exhibits an optimized spray pattern.

It is also recognized that significant energy losses occur at the sprinkler assemblies where the fluid is dispersed. As discussed herein, conventional sprinkler assemblies often include a frame having a pair of arms, which attach to either side of the sprinkler body, and aligns the deflector with the path of the water when it is discharged through the outlet opening. The arms are often joined at their distal ends by a boss, which is used to mount the deflector to the arms. Pendent sprinklers and upright sprinklers typically include deflectors with a solid central portion and a plurality of tines that extend radially outwardly from the central portion for dispersing the fluid as it flows across the solid central portion, which is mounted to the boss and typically aligned with the discharge opening of the base. Sidewall sprinklers typically include a deflector, also with a solid central portion with tines extending from the central portion and a blade that is positioned above the central portion to direct the fluid that flows above the central portion outwardly and downwardly. In each case, when the fluid flows from the discharge opening of the base the fluid impinges on the boss and on the central portion of the deflector. The boss and deflector disperse the fluid radially outward, and the fluid is thereafter further dispersed by the tines, and in the case of the sidewall sprinklers also by the blade. This results in a sizeable energy or head loss in the fluid at the sprinkler assembly. Significant savings can be realized for a sprinkler system if the supply pressure to the sprinkler assembly can be reduced. As would be understood by those skilled in the art, where the supply pressure to the sprinkler assemblies of a system can be reduced, the size of the piping delivering the fluid to the sprinkler assemblies can be reduced and/or the size of the system pump can be downsized. If comparable performance of a sprinkler assembly can be provided at a lower pressure for any given system, the need for a pump might even be avoided. Any of these modifications could provide significant savings in the installation cost of a fire protection system. Accordingly, a sprinkler assembly, that combines the benefits of a concealed sidewall arrangement, that can disperse fluid with a reduced head loss may reduce the required pressure at the sprinkler assembly and, hence, provide cost savings for the installation of a fire protection system incorporating such sprinkler assemblies.

SUMMARY

This section provides a general summary of the disclosure, and is not a comprehensive disclosure of its full scope or all of its features.

The present invention provides a flush side wall sprinkler assembly which includes an improved deployment assembly and flow shaper assembly. The flow shaper assembly optimizes the dispersion of the water as it flows from the outlet by directing the flow of water in a converging direction from the sprinkler assembly when the sprinkler assembly is exposed to temperatures associated with a fire.

According to the principles of the present teachings, a sprinkler assembly is provided having a base including a passageway, an inlet opening communicating with a pressurized fluid source, an outlet opening for outputting a flow of pressurized fluid along a flow path, and an axis extending through the outlet opening. A top is provided extending from the base having a retaining ridge, such that the top and the base define a cavity. A deployment assembly is provided supporting a flow shaper assembly, whereby the deployment assembly is movably mounted to at least one of the base and the top and is movable horizontally between a retracted position and an extended position for dispersing the pressurized fluid from the outlet opening. A heat responsive trigger is mounted to releasably retain the deployment assembly within the retracted position. The flow shaper assembly can comprise at least one contact surface for shaping the flow of pressurized fluid from the outlet opening when the deployment assembly is in the extended position. The flow shaper assembly can comprise an opening aligned along the axis extending through the outlet opening, which is at least generally aligned along the flow path extending from the outlet opening along the axis such that the fluid flows unimpeded through the opening of the flow shaper assembly. The flow shaper assembly can comprise a flow shaper provided at the opening of the flow shaper assembly that extends radially inward from a perimeter of the opening toward the axis to shape the flow of fluid which flows from the outlet opening.

In some embodiments, the deployment assembly is movable horizontally between the retracted position, wherein at least a portion of the flow shaper is recessed within the cavity, and the extended position, wherein the flow shaper is spaced from the outlet opening for dispersing the pressurized fluid which flows from the outlet opening.

In some embodiments, the heat responsive trigger comprises a pair of elements interconnected by heat fusible material that melts upon detection of temperatures associated with a fire. The heat responsive trigger can apply a biasing force to urge the deployment assembly toward the retracted position and releasing the biasing force when the heat fusible material melts.

In some embodiments, the flow shaper comprises one or a plurality of tab members. In some embodiments, the opening of the flow shaper assembly is at least as large as the outlet opening to maintain the unimpeded flow.

In some embodiments, the deployment assembly comprises a deflector ring slidably movable within the cavity and at least one deflector pin extending between the deflector ring and the flow shaper assembly operably coupling the flow shaper assembly to the deflector ring for movement therewith. The deflector ring can engage the retaining ridge of the top when the deployment assembly is in the extended position.

In some embodiments, the sprinkler assembly further comprises a seat assembly that is disposed between the outlet opening and the flow shaper assembly. The seat assembly sealingly engages the outlet opening to generally inhibit flow of the pressurized fluid when the deployment assembly is in the retracted position. The seat assembly is removable in response to the movement of the deployment assembly from the retracted position to the extended position.

The flow shaper assembly can comprise a halo portion having a central aperture, and a flow shaper disposed within the central aperture of the halo portion. The flow shaper can define the opening of the flow shaper assembly.

In some embodiments, a guide member can operably engage at least one of the deployment assembly, the flow shaper assembly, and the heat responsive trigger to generally maintain axial alignment with the base when the sprinkler assembly is horizontally mounted. This can aid in preventing sagging of the sprinkler assembly that can result in binding of the sprinkler assembly.

Finally, in some embodiments, a cover assembly can be utilized to conceal the horizontal sidewall sprinkler. The cover assembly can include a flat plate cover that can have, for example, a 135° F. rating that will fall away from the assembly in the event of a first exposing the sprinkler assembly.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
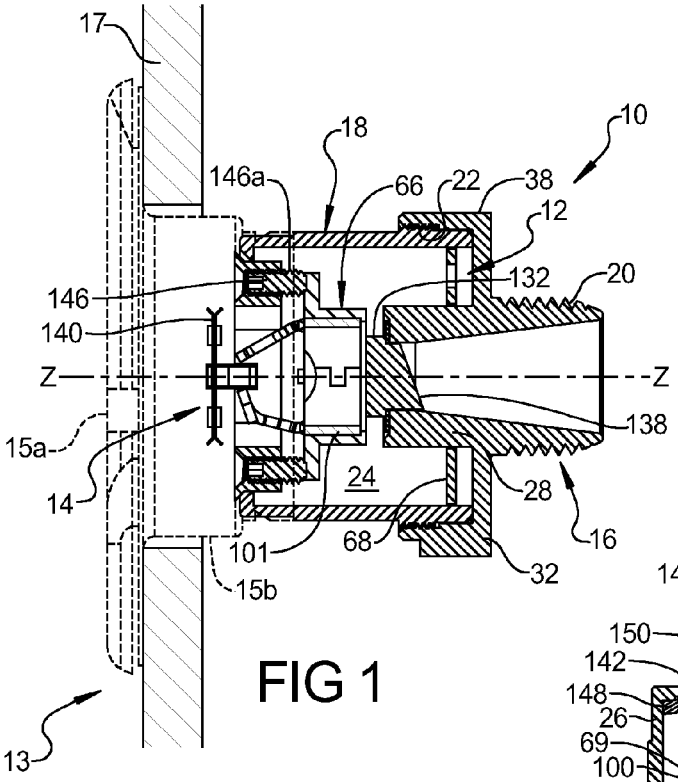
FIG. 1 is a cross-sectional view taken along line 1-1 of FIG. 3, illustrating a sprinkler assembly according to the principles of the present teachings.

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
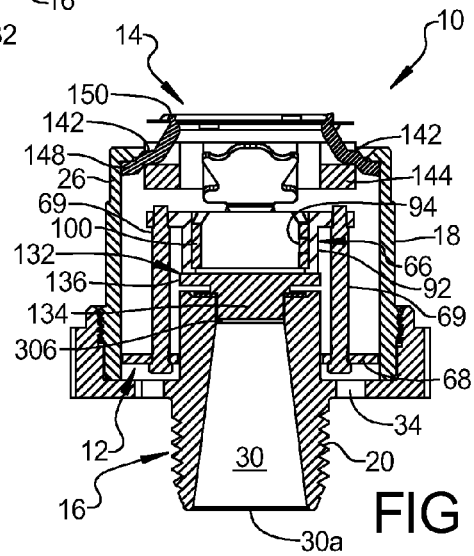
FIG. 2 is a cross-sectional view taken along line 2-2 of FIG. 3, illustrating the sprinkler assembly of FIG. 1.
Figure 3:
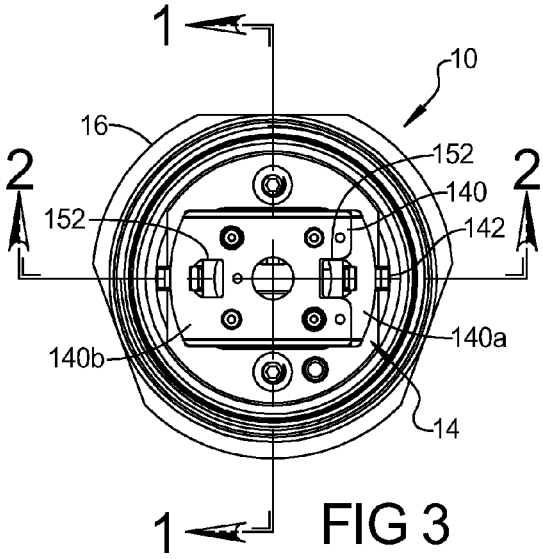
FIG. 3 is a plan view of the sprinkler assembly of FIG. 1.

Referring to FIGS. 1-3, the numeral 10 generally designates a flush sprinkler assembly of the present invention especially suitable for side wall mounting. Sprinkler assembly 10 mounts in an opening provided in a side wall of a building and includes an improved movable deployment assembly 12 (FIGS. 1 and 2) and thermal sensitive element assembly 14 (FIGS. 1-3) which results in a rapid response when the sprinkler is exposed to a temperature of a preselected value which is associated with a fire and an improved trajectory of a fire extinguishing fluid, for example water. Henceforth, reference will be made to water as the fire extinguishing fluid, but it will be understood by those skilled in the art that other fire extinguishing fluids or fire suppressants may be used. The sprinkler assembly 10 can be employed with a cover assembly 13, as is known in the art, to provide a flat plate concealed horizontal sidewall sprinkler. The cover assembly 13 can include a flat plate cover 15*a* that has a temperature rating of, for example, 135° F. and that will fall away in the event of a fire to expose the thermal sensitive element assembly 14. The flat plate cover 15*a* can be removably supported by a can 15*b* in close proximity to a wall. The cover 15*a* can be removably connected to the can 15*b* by heat sensitive solder. The cover 15*a* can have a generally planar body generally spanning the width of the can 15*b* with an optional outer flange extending from a perimeter of the body. The can 15*b* can include an annular base connected to the sprinkler assembly and a flange portion connected to the cover 15*a* by the heat sensitive solder.

Referring to FIGS. 1-3, in some embodiments, sprinkler assembly 10 can comprise a base 16 being preferably made of metal components and, more preferably, brass components, being coupled to a top 18. Base 16 can comprise a first threaded portion 20 for coupling to a pressurized water supply system and a second threaded portion 22 for coupling to top 18. Other types of connection between base 16 and top 18 can be employed, and the base and top can be integrally formed. Together, base 16 and top 18 define a cavity 24 for receiving deployment assembly 12 and thermal sensitive element assembly 14 (FIG. 3). That is, deployment assembly 12 and thermal sensitive element assembly 14 are mounted to base 16 and top 18 and deployment assembly 12 is recessed within cavity 24 during a non-activated state, as will be more fully described below. In some embodiments, the heat responsive cover assembly 13 can be mounted to top 18 to provide a mounting flange and conceal an opening in the sidewall when the sprinkler assembly 10 is mounted. In some embodiments, top 18 can comprise a necked-down diameter portion 26 disposed on a distal exterior end of top 18 for receiving the cover assembly 13 thereon via press-fit, interference-fit, or other conventional mounting connection.

Figure 4:
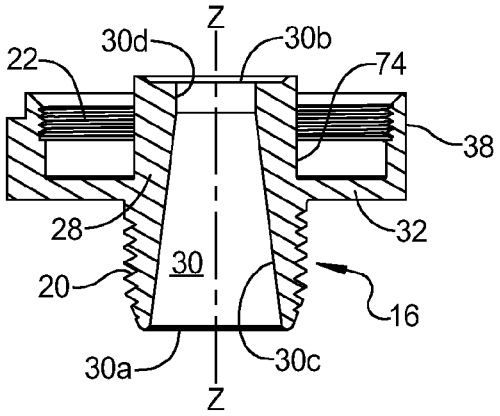
FIG. 4 is a cross-sectional view illustrating the base of the sprinkler assembly.

With particular reference to FIGS. 1-8, in some embodiments, base 16 can comprise a central portion 28 having a central passage 30 extending therethrough coaxial with central portion 28 and sprinkler assembly 10 (see axis Z-Z in FIG. 1). Central passage 30 can define an inlet opening 30*a* at a proximal end of base 16 and an outlet opening 30*b* at a distal end of base 16 within cavity 24 (FIGS. 1, 4, 6 and 8). In some embodiments, as best shown in FIG. 4, central passage 30 can be tapered to include a first section 30*c*, having a decreasing diameter in the flow direction, such as a 14° taper, and a second section 30*d* downstream of said first section 30*c*, having a constant diameter. It should be appreciated, however, that alternative central passage profiles can be used, including constant, stepped, varying, increasing diameter, decreasing diameter, nozzle, and the like. Moreover, it should be appreciated that the size of central passage 30 can be varied to achieve a predetermined flow rate based on known design properties.

Figure 5:
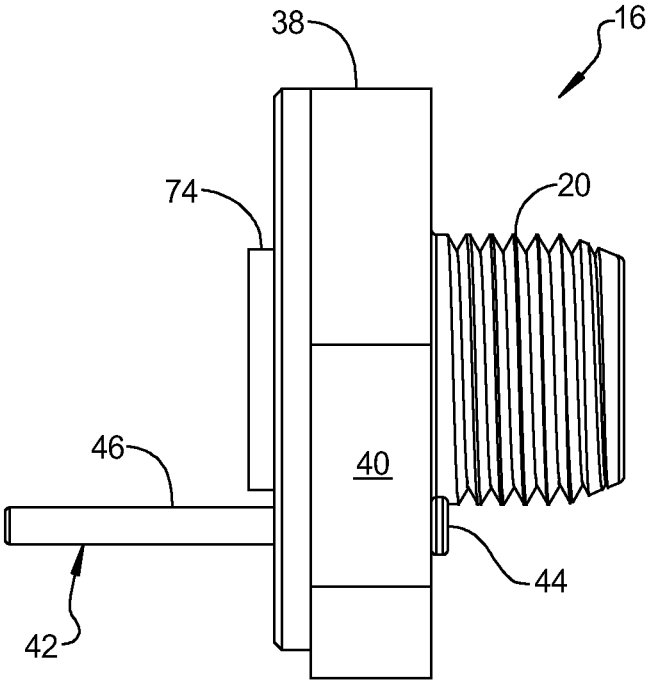
FIG. 5 is a side view illustrating the base of FIG. 4.
Figure 6:
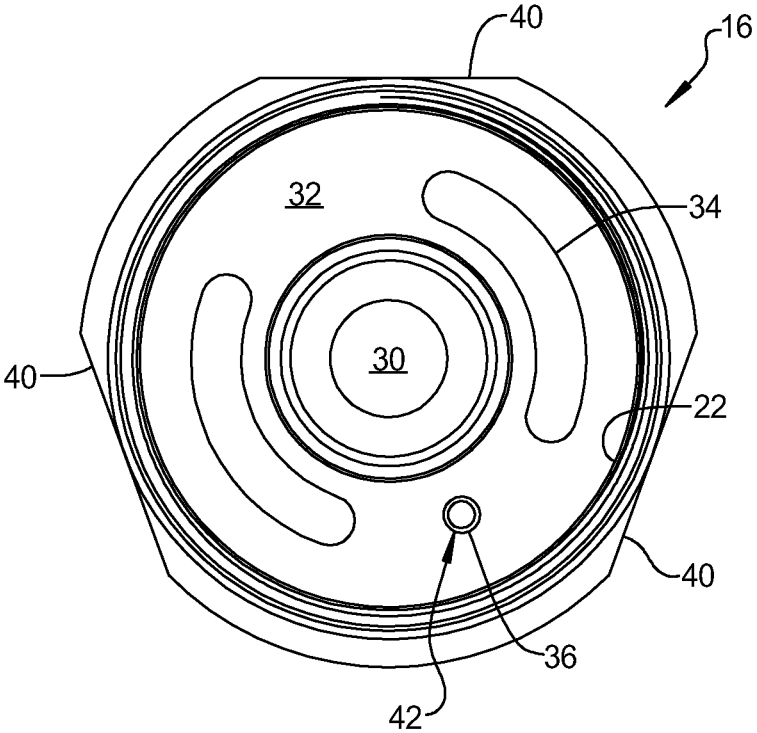
FIG. 6 is a plan view illustrating the base of FIG. 4.
Figure 7:
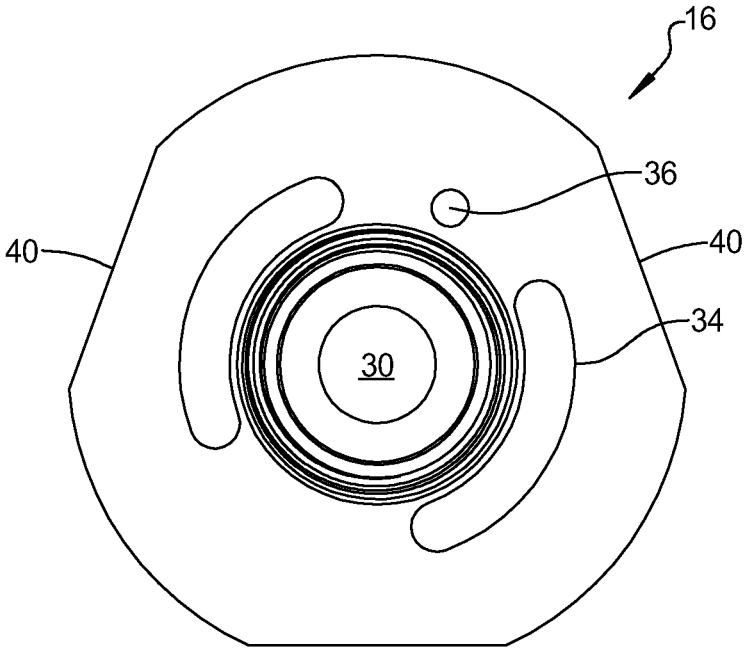
FIG. 7 is a bottom view illustrating the base of FIG. 4.
Figure 8:
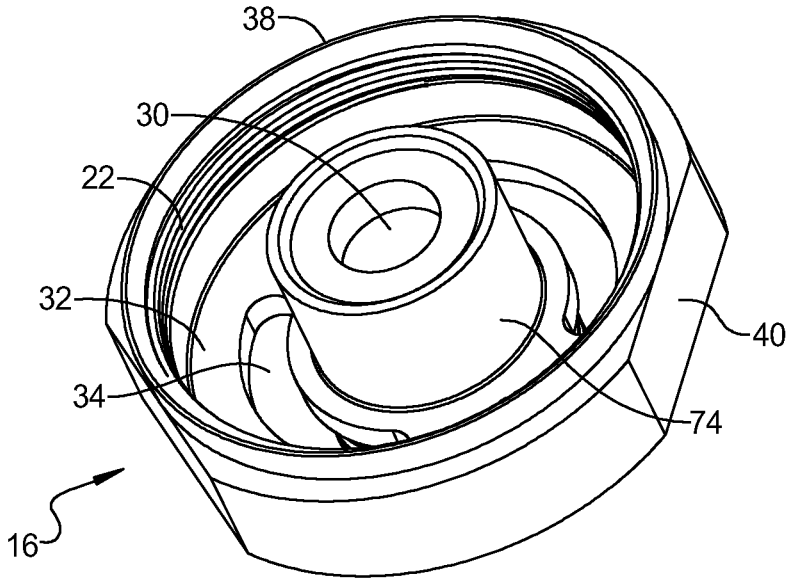
FIG. 8 is a perspective view illustrating the base of FIG. 4.
Figure 9:
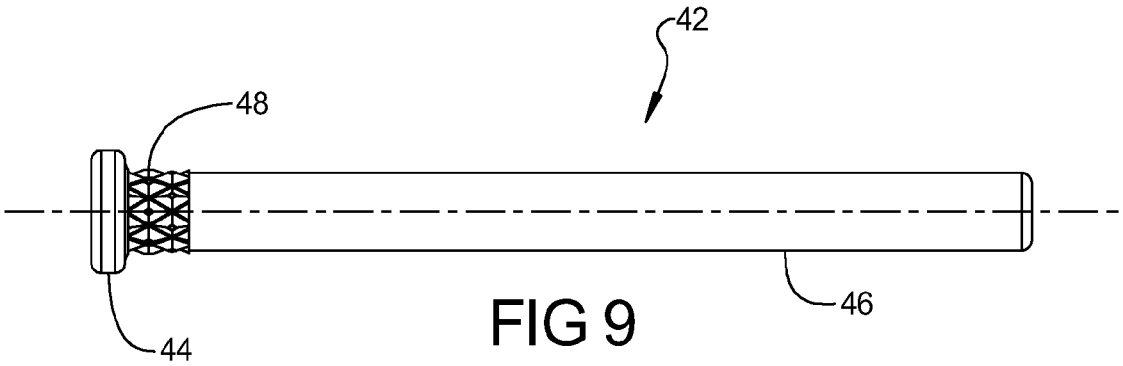
FIG. 9 is a side view illustrating a guide pin of the sprinkler assembly.

Still referring to FIGS. 1-8, base 16 can further comprise a flange portion 32 extending radially from central portion 28 at a position distal of first threaded portion 20, generally orthogonal to axis Z-Z. Flange portion 32, in some embodiments, can comprise arcuate slots 34 extending therethrough and/or one or more apertures 36. Arcuate slots 34 can have alternative shapes such as round, square, oval, rectangle, etc., and permit airflow to pass therethrough to provide improved activation of sprinkler assembly 10 and/or improved deployment and performance. Aperture 36 can be a threaded aperture for the coupling of one of more guide members 42 (FIG. 5). As seen in FIGS. 5 and 9, guide member 42 can be an elongated member having an enlarged head 44 sized greater than aperture 36 to prevent passage therethrough and a body 46 extending from enlarged head 44 and sized to be received through aperture 36 and extend generally parallel to axis Z-Z, and offset therefrom, within cavity 24. In some embodiments, body 46 and/or an optional knurled portion 48 of body 46 can be sized to define a press-fit or interference fit with aperture 36 of base 16 to retain guide member 42 in a predetermined position. Body 46 of guide member 42 can be slidably receiving within an aperture formed in a deflector ring 68 (FIG. 13, to be described) for restraining rotation movement of the deflector ring 68.

Referring again to FIGS. 1-8, base 16 can further comprise an upstanding wall portion 38 extending from a periphery of flange portion 32 and defining a central axis generally coaxial with axis Z-Z. Upstanding wall portion 38 can comprise second threaded portion 22 disposed along an internal sidewall thereof for threaded coupling with top 18. In some embodiments, upstanding wall portion 38 can further comprise one or more external surfaces 40 for engagement with an installation tool, such as a socket, wrench, or the like, to permit improved leverage during threaded engagement of first threaded portion 20 and the pressurized water supply system.

Figure 10:
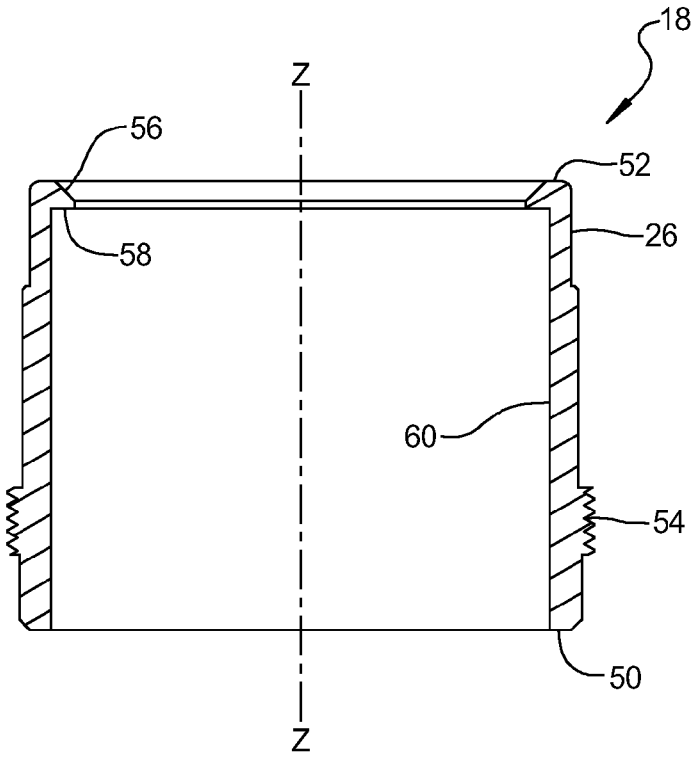
FIG. 10 is a cross-sectional view illustrating the top of the sprinkler assembly.
Figure 11:
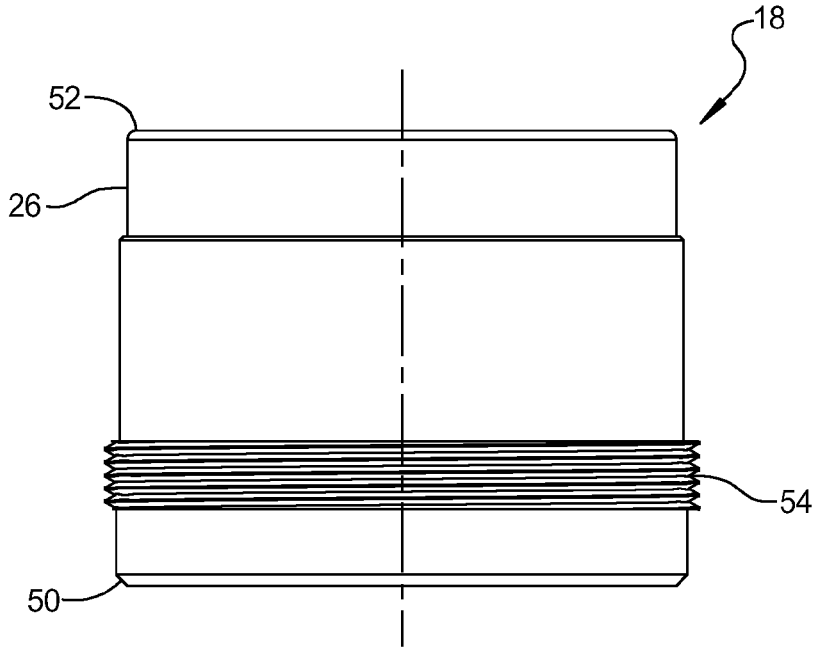
FIG. 11 is a side view illustrating the top of FIG. 10.
Figure 12:
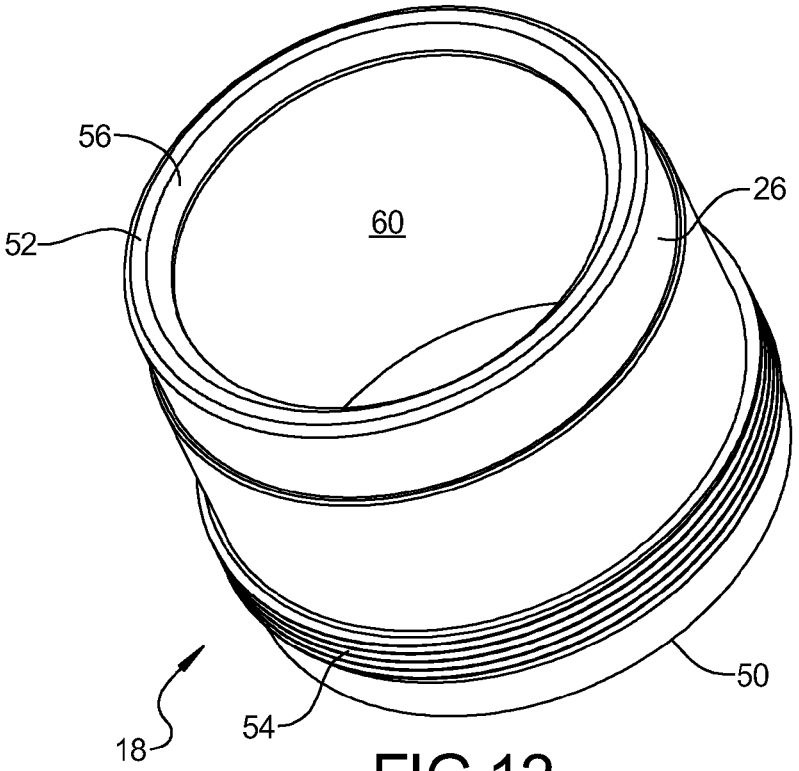
FIG. 12 is a perspective view illustrating the top of FIG. 10.

Referring now to FIGS. 10-12, in some embodiments, top 18 can comprise a cylindrical shape having a proximal open end 50 and a distal open end 52. In some embodiments, top 18 is made of metal. Proximal end 50 can comprise a threaded portion 54 sized to threadedly engage second threaded portion 22 of base 16 to couple top 18 to base 16. In some embodiments, an adhesive, such as an anaerobic adhesive, can be disposed within this thread engagement to inhibit inadvertent disengagement thereof. The threaded portion 54, in some embodiments, can be offset a distance from proximal end 50. As discussed herein, top 18 can further comprise necked-down diameter portion 26 disposed on a distal exterior end of top 18 for receiving the cover assembly 13 thereon via press-fit, interference-fit, or other conventional mounting connection. Still further, in some embodiments, top 18 can comprise an inwardly-directed, circumferential flange 56 along distal open end 52 extending within an internal volume of top 18 and cavity 24. Circumferential flange 56 can form a retaining ridge 58 (FIG. 10) for engaging deflector ring 68 (FIGS. 1 and 2) when sprinkler assembly 10 is in an activated position. Top 18, in some embodiments, can comprise a generally smooth internal wall surface 60 having a generally constant diameter. However, it should be appreciate that internal wall surface 60 can define alternative cross-sectional shapes, alternative and varying longitudinal sizes, and other configurations.

Figure 13:
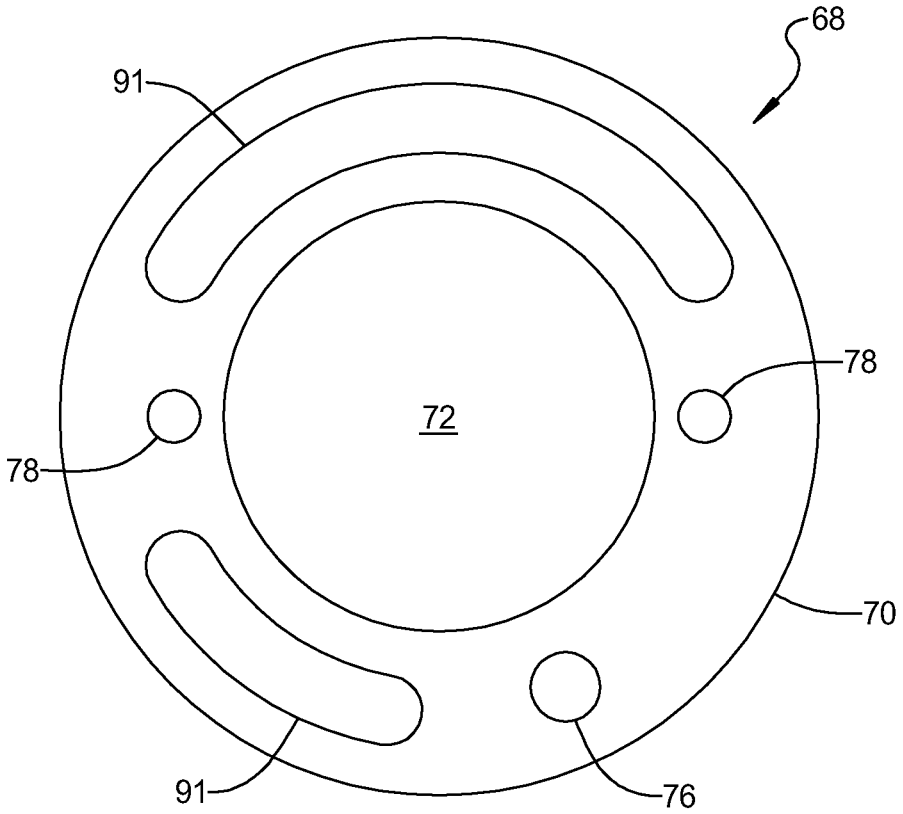
FIG. 13 is a plan view illustrating a deflector ring of the sprinkler assembly.

Referring now to FIGS. 1, 2, and 13, sprinkler assembly 10 can comprise deployment assembly 12. In some embodiments, deployment assembly 12 can comprise a deflector ring 68, at least one deflector pin 69 (best shown in FIG. 14), and flow shaper assembly 66 (best shown in FIGS. 15 and 16). Generally, deployment assembly 12 is movably mounted relative to base 16 and/or top 18 along axis Z-Z (horizontal when installed). Similar to base 16 and top 18, deployment assembly 12 is preferably a metal assembly, with deflector ring 68 preferably comprising a brass material. When sprinkler assembly 10 is installed, deflector ring 68 moves generally horizontally along axis Z-Z between a retracted or inactive position within cavity 24 in which deflector ring 68 is preferably completely contained or recessed in cavity 24 and an extended or active position in which deflector ring 68 is spaced from outlet opening **30*b* and generally engaging retaining ridge 58 of top 18 to disperse the water which flows from outlet opening 30*b***.

Referring to FIG. 13, in some embodiments, deflector ring 68 can comprise a generally-circular, planar member having a circular outer surface 70 and a central aperture 72 each defining an axis coaxial with axis Z-Z. In some embodiments, outer surface 70 can be sized to closely conform to inner wall surface 60 of top 18 to permit guided sliding movement relative thereto. It should be appreciated that alternative nesting and complementary shapes between outer shape 70 of deflector ring 68 and inner wall surface 60 of top 18 can be used, such as a keyed engagement (extending member of one piece engaging a corresponding channel in the other piece). Outer surface 70 is sized to engage retaining ridge 58 of top 18 to prevent further extension of deployment assembly 12 in the extended or active position.

Central aperture 72 of deflector ring 68 is generally circular and sized to closely conform to an outer wall surface 74 (FIGS. 4, 5, and 8) of central portion 28 of base 16 to permit guided sliding movement relative thereto. Moreover, central aperture 72 permits deflector ring 68, associated deflector pins 69, and deployment assembly 12 to be nested or otherwise disposed within cavity 24 such that deflector ring 68 is generally adjacent to flange portion 32 of base 16 when sprinkler assembly 10 is in the retracted and inactive position (see FIGS. 1 and 2).

Deflector ring 68, in some embodiments, can further comprise a guide member aperture 76. Guide member aperture 76 can be sized and offset relative to the axis Z-Z and generally aligned with guide member 42 (see FIG. 5) for engagement therewith. In this way, guide member 42, extending from base 16, is generally slidably received with guide member aperture 76 of deflector ring 68 to maintain a rotationally-relative position of deflector ring 68, deflector pins 69, and flow shaper assembly 66 relative to base 16. In this way, as will be described, during activation of sprinkler assembly 10, the spray pattern of the extinguishing fluid from flow shaper assembly 66 can be predictive and consistent because of the minimized rotation misalignment of flow shaper assembly 66 to the extinguishing fluid flow column. To this end, guide member aperture 76 can be sized to closely conform to the size of body 46 of guide member 42 while simultaneously providing unencumbered deployment of deployment assembly 12.

Figure 14:
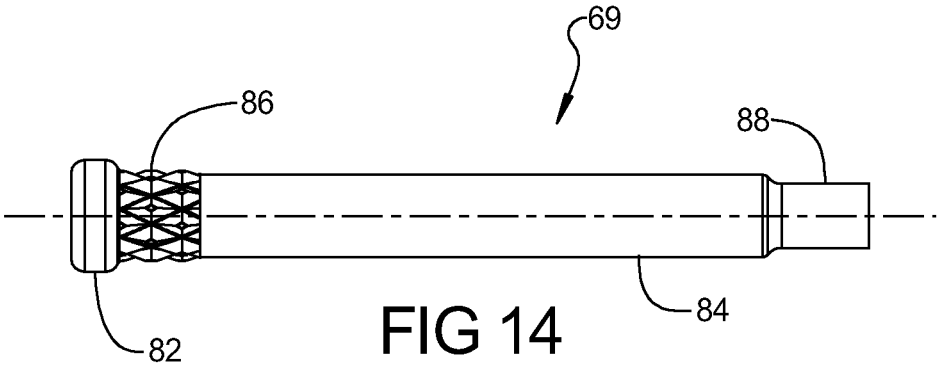
FIG. 14 is a side view illustrating a deflector pin of the sprinkler assembly.

Still further, in some embodiments as illustrated in FIGS. 1, 13, and 14, deflector ring 68 can comprise one or more deflector pin apertures 78. In some embodiments, deflector pin apertures 78 can be sized and offset relative to the axis Z-Z to be generally aligned with corresponding deflector pins 69 (FIG. 14). Deflector pin apertures 78 can be threaded apertures for threaded coupling with corresponding deflector pins 69 (FIG. 14), although other coupling techniques can be used, such as press fit and mechanical staking. As seen in FIG. 14, each deflector pin 69 can be an elongated member having an enlarged head 82 sized greater than deflector pin aperture 78 to prevent passage therethrough and a body 84 extending from enlarged head 82 and sized to be received through deflector pin aperture 78 and extend parallel to axis Z-Z, and offset therefrom, within cavity 24. In some embodiments, body 84 and/or optional knurled portion 86 of body 84 can be sized to define a press-fit or interference fit with deflector pin aperture 78 of deflector ring 68 to retain deflector pin 69 in a predetermined position. Body 84 of deflector pin 69 terminates at a tip 88, which can be over-sized or otherwise threaded, that is fixedly coupled to apertures 90 (FIG. 15; see FIG. 2)) formed in flow shaper assembly 66, as will be further described. This enables generally fixed coupling of deflector ring 68, deflector pins 69, and flow shaper assembly 66 for movement between the retracted and inactive position and the extended/deployed and active position.

Finally, as illustrated in FIG. 13, deflector ring 68 can comprise one or more arcuate slots 91 extending therethrough to permit airflow to pass therethrough to provide ventilation of sprinkler assembly 10 and/or improved deployment and performance.

Referring now to FIGS. 1, 2, and 15-17, deployment assembly 12 comprises flow shaper assembly 66. In some embodiments, flow shaper assembly 66 can comprise a unitary member or two or more pieces. It should be understood that such distinctions should not be regarded as limitations, but merely alternative configurations. Therefore, although the following description of flow shaper assembly 66 will be made in connection with a two-piece design, it should be understood that a single unitary piece design or other multi-piece designs are regarded as part of the present teachings.

Figure 17:
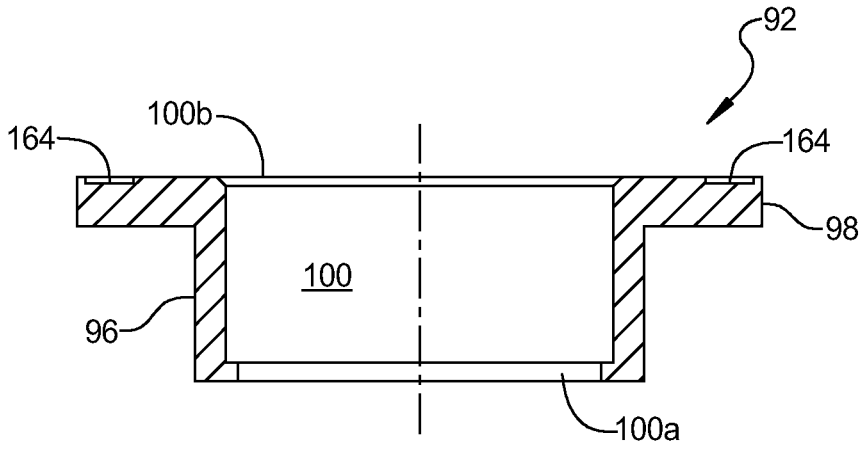
FIG. 17 is a cross-sectional view illustrating the halo portion of the flow shaper assembly of FIG. 15.

In some embodiments, flow shaper assembly 66 can comprise a halo section 92 and a flow shaper 94 extending from halo section 92. As seen in FIG. 17, halo section 92 can define a generally-cylindrical central body portion 96 having a radially-extending flange portion 98 extending orthogonally from body portion 96 and formed integrally therewith. Central body portion 96 can comprise a central passage 100 extending therethrough having a proximal opening 100*a* and a distal opening 100*b*. Central passage 100 is sized greater than that of the column of extinguishing fluid from outlet opening 30*b* such that the extinguishing fluid is able to flow unencumbered through central passage 100. In other words, central passage 100 is sufficiently large in size so as not to impede the flow of the extinguishing fluid from outlet opening 30*b* to flow shaper 94, which resided downstream of central passage 100.

In some embodiments, halo section 92 can further comprise a guide pin slot, aperture, notch, or other feature 102 formed in flange portion 98. Guide pin feature 102 is provided for engagement with guide member 42 extending from base 16. In this way, guide member 42, extending from base 16, is received within guide member aperture 76 of deflector ring 68 and further through guide pin feature 102 of halo section 92 of flow shaper assembly 66. The guide member 42 serves to align deployment assembly 12 (namely, deflector ring 68, deflector pins 69, and flow shaper assembly 66) relative to base 16. This is useful in that conventional side-mount sprinklers tend to sag or otherwise tilt down toward the floor after deployment if water pressure is interrupted. Once water pressure returns, conventional sprinklers may bind or otherwise be forced into this misaligned configuration, which reduces their spray pattern, range, flow rate, and/or effectiveness. Moreover, as described herein, guide member 42 further inhibits rotation of flow shaper assembly 66 about axis Z-Z, which could negatively impact the water distribution spray profile. Finally, it should be appreciated that guide member 42 further aids in assembly of sprinkler assembly 10 and serves as a guide during the placement of parts to ensure proper orientation thereof.

Referring to FIGS. 1, 2, 15, and 16, when extinguishing fluid flows from outlet opening 30*b* of base 16, the fluid generally forms a column of fluid, which is substantially unencumbered by any structure until it contacts flow shaper 94. In other words, sprinkler assembly 10 has a flow path from outlet opening 30*b* that is unencumbered by base 16 or halo section 92. Furthermore, when the fluid is contacted by flow shaper 94, flow shaper 94 operates on the column of fluid from its outer surface radially inward—in contrast to a conventional deflector and frame, which act as abutments and then redirect the fluid and spread the column of fluid generally from its center to fan the fluid radially outward and, thereafter, disperses the fluid as the fluid flows around the deflector. As would be understood, therefore, in a conventional sprinkler, the fluid experiences significant energy loss due to the friction and deflection between the fluid and the frame and the deflector.

Figure 15:
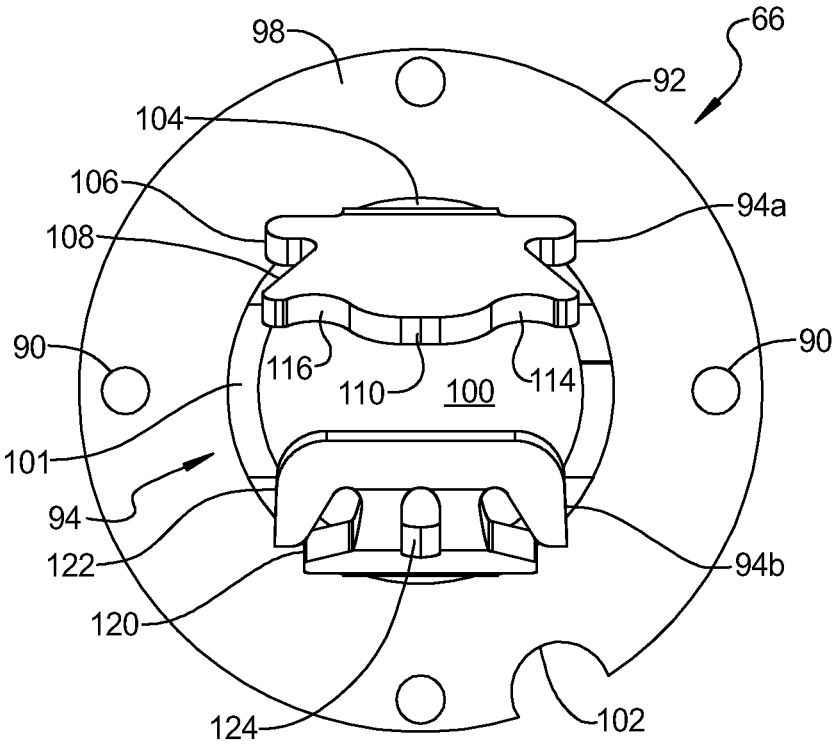
FIG. 15 is a plan view illustrating a flow shaper assembly of the sprinkler assembly.
Figure 16:
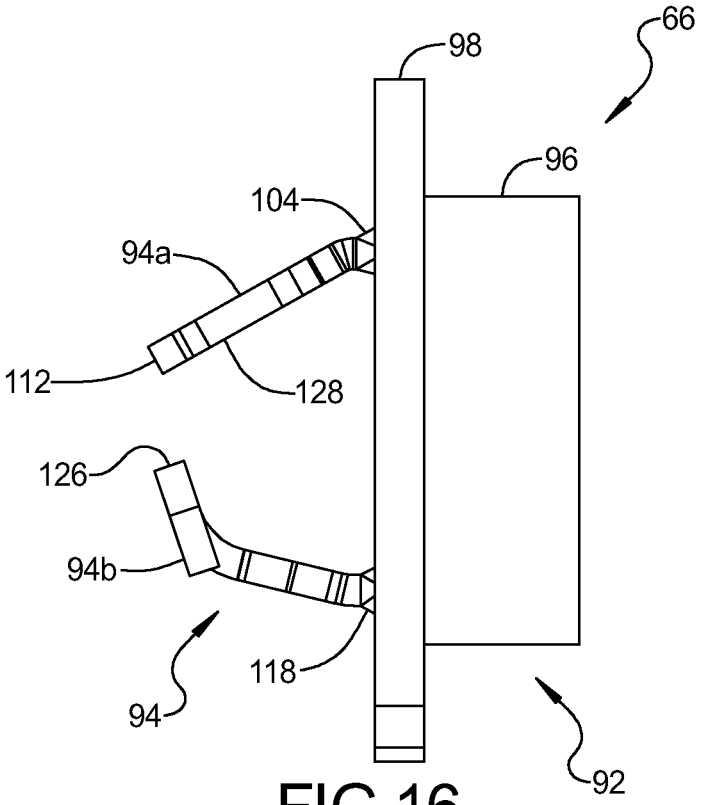
FIG. 16 is a side view illustrating the flow shaper assembly of FIG. 15.

As seen in FIGS. 15 and 16, in some embodiments, flow shaper 94 can comprise a flow shaper as described in commonly-assigned U.S. patent application Ser. No. 11/388,072. In some embodiments, flow shaper 94 can comprise a pair of tabs 94*a* and 94*b* that are mounted to or formed with an annular member 101 (FIG. 15) or formed with halo section 92, which collectively form a flow shaper. It should be understood that the number of tabs, the size of the tabs, the shape of the tabs, and the location of the tabs may vary depending upon the desired fluid dispersement pattern. The annular member 101 can comprise an annular wall and a central opening and can be sized to fit and mount in central passage 100 of halo section 92 and, further, configured so that the fluid flows through the central opening of the annular member 101 unencumbered as described in connection with central passage 100. In this manner, flow shaper 94 can be attached to halo section 92 by mounting the annular member 101 within central passage 100.

In some embodiments, the opening of the annular member 101, if the flow shaper 94 is formed separate from halo section 92, or central passage 100, if the flow shaper 94 is formed integrally with halo section 92, is preferably at least as large in diameter as outlet opening 30*b*. In this manner, most, if not all, of the fluid discharged from outlet opening 30*b* may flow through flow shaper assembly 66 unimpeded by halo section 92 or the annular member 101.

As seen in FIGS. 15 and 16, tab 94*a* comprises a solid, generally polygon-shaped plate having a base 104 that is coupled to and extending from annular member 101 or halo section 92. Tab 94*a* can comprise spaced, generally parallel edges 106 having notches 108 that extend laterally outward from the annular member 101 or halo section 92. At its outer end, tab 94*a* can comprise at its outer free edge 110 a central flat edge 112 bounded by a pair of arcuate-shaped edges 114 and 116. Arcuate-shaped edges 114, 116 may be semi-circular, for example, and provide additional dispersion of the fluid as it flows between tabs 94*a* and 94*b*. The edges 110 through 116 define a finger shape that distributes the water in a desired pattern. It should be noted that multiple fingers may be desired to achieve different distribution patterns.

Tab 94*b* is also coupled to or formed with annular member 101 or halo section 92 by a base 118 and comprises a generally rectangular plate with trapezoidal-shaped notches 120 at its opposed edges 122, as best shown in FIGS. 15 and 16. In addition, tab 94*b* may include one or more slotted openings 124. Slotted opening 124 allows some of the fluid to flow through tab 94*b*, as would be understood by those skilled in the art. The number, size, and shape of slotted openings 124 can be varied in order to obtain a desired flow pattern. At its outer end, the plate is bent or curved toward tab 94*a* with its outer edge 126 extending generally parallel to edge 128 of tab 94*a*. In addition, edge 126 may include a pair of notches, if desired. In this manner, tab 94*b* is arranged to lift some of the fluid flowing from central passage 100 and to fan the fluid laterally outward and downward.

In the illustrated embodiment, tabs 94*a* and 94*b* extend from annular member 101 or halo section 92 from opposed sides and are generally aligned along axis Z-Z. However, it should be understood that tabs 94*a*, 94*b* or additional tabs may be located at other locations or alignments.

As illustrated in FIGS. 1 and 2, when deployment assembly 12 is in its closed position, a seat assembly 132 extends through outlet opening 30*b* and is positioned in central passage 30. In some embodiments, seat assembly 132 sealingly engages central passage 30 and/or outlet opening 30*b*. As will be described in greater detail in reference to thermal sensitive element assembly 14, when in the unactivated state, deployment assembly 12 is biased toward base 16 in cavity 24 and seat assembly 132 sealingly engages, thereby closing, outlet opening 30*b*. However, when thermal sensitive element assembly 14 is activated to open by exposure to temperatures associated with a fire, deployment assembly 12 being no longer biased towards base 16 moves to its extended position with deployment assembly 12 spaced from outlet opening 30*b* under the force of the water pressure. The water pressure pushes on seat assembly 132 and flow shaper assembly 66 to push deployment assembly 12 to its extended position until deflector ring 68 engage retaining ridge 58 of top 18. Once in the extended position, flow shaper assembly 66 further disperses the flow of water from outlet opening 30*b* with tabs 94*a* and 94*b* dispersing and directing the flow of water. In some embodiments, seat assembly 132 can comprise a solid central portion 134 and at least a pair of wing portions 136 extending from central portion 134. Central portion 134 can be sized to be received within outlet opening 30*b* and can comprise, in some embodiments, an angled proximal surface 138. Angled proximal surface 138 can be contacted by water during activation to exert a non-axial force upon central portion 134 to cause seat assembly 132 to tumble free of sprinkler assembly 10 and out of the column of fluid. At least one of central portion 134 and wing portions 136 can engage or otherwise contact a proximal end of halo section 92 to exert a force thereupon during activation in response to the column of fluid. Additional structure can be provided to deflect the seat assembly 132 out of the water flow path during deployment of the deployment assembly 12.

As previously described, deployment assembly 12 is biased in its non-activated or retracted position by thermal sensitive element assembly 14. Referring again to FIGS. 1-3, thermal sensitive element assembly 14 can comprise a fusible plate assembly 140, a pair of levers or arms 142, a lever bar ring 144, and a pair of set screws 146. Fusible plate assembly 140 can comprise a first fusible plate member 140*a* and a second fusible plate member 140*b* which are joined by heat fusible or heat sensitive material. Heat fusible materials are generally known in the automatic sprinkler industry and is generally recognized as a material used in the art possessing the requisite degree of bonding strength and thermal sensitivity such that when the fusible plate assembly 140 is exposed to temperatures associated with a fire the heat fusible material melts releasing the connection between plate members 140*a* and 140*b*.

Referring to FIGS. 1-3 and 18-20, thermal sensitive element assembly 14 is mounted to sprinkler assembly 10 through a releasable binding system. In this way, levers 142 are supported by lever bar ring 144 and extend under retaining ridge 58 of top 18 to releasably mount thermal sensitive element assembly 14 to base 16. As best seen in FIG. 2, each lever 142 can comprise a groove engaging portion 148 for engaging retaining ridge 58 and a fusible plate engaging portion 150 for engaging fusible plate assembly 140. Fusible plate engaging portions 150 of levers 142 extend through apertures 152 (FIG. 3) which are provided in the fused together plate members 140*a* and 140*b*. Together groove engaging portion 148 and fusible plate engaging portion 150 form a generally inverted L-shaped cross-section which will provide a biased lever type action.

Figure 18:
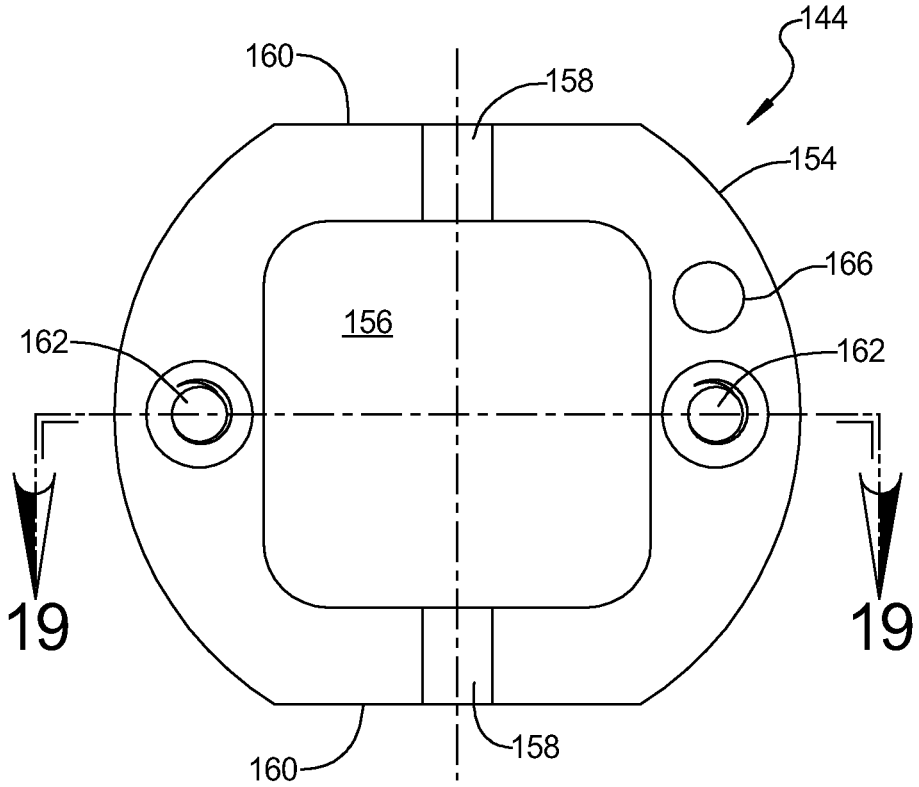
FIG. 18 is a plan view illustrating the lever bar ring of the sprinkler assembly.
Figure 19:
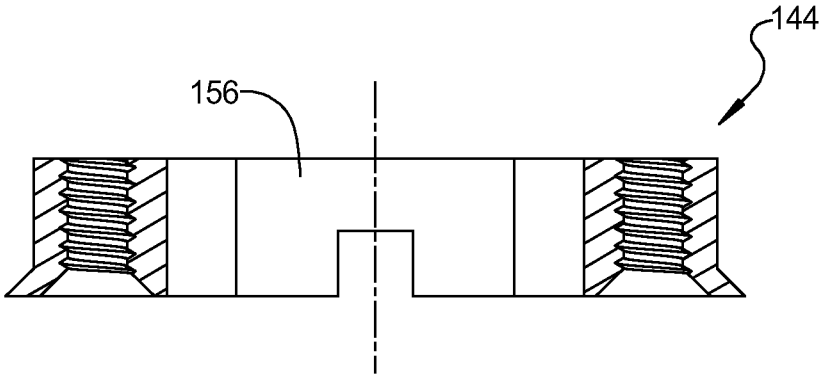
FIG. 19 is a cross-sectional view taken along line 19-19 of FIG. 18.
Figure 20:
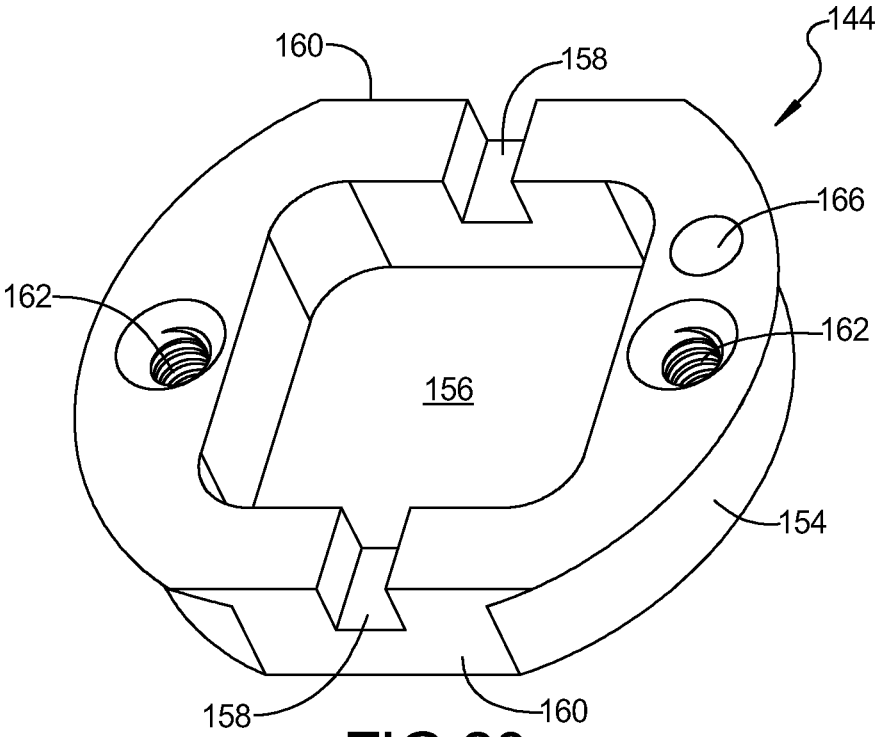
FIG. 20 is a perspective view illustrating the lever bar ring of FIG. 18.

Lever bar ring 144 is positioned beneath levers 142 and biases levers 142 outwardly from cavity 24. As best seen in FIGS. 18-20, lever bar ring 144 is generally ring-shaped having an outer shape surface 154. Outer shape surface 154 is sized to be received within the distal opening of top 18. Lever bar ring 144 can further comprise a central aperture 156 extending therethrough. Central aperture 156 can, in some embodiments, be sized to receive at least a portion of tabs 94*a*, 94*b* therethrough. Lever bar ring 144 can further comprise a pair of lever channels 158 for receiving and stabilizing levers 142 when extending between retaining ridge 58 of top 18 and apertures 152 in plate members 140*a* and 140*b*. Outer shape surface 154 of lever bar ring 144 can further comprise flattened surfaces 160 to permit routing of lever 142.

As seen in FIGS. 1, 3, and 18-20, lever bar ring 144 can further comprise a pair of threaded through-holes 162 sufficiently sized to threadingly engage the pair of set screws 146. That is, as seen in FIG. 1, set screws 146 can extend through the holes 162 and engage a pocket 164 (FIG. 17) of flange portion 98 of halo section 92. Accordingly, as illustrated in FIG. 1, when groove engaging portions 148 of levers 142 are positioned in retaining ridge 58 and fusible plate engaging portions 150 are extended through apertures 152, set screws 146 are tightened such that distal end 146*a* of the set screws extend into associated pockets 164 (FIG. 17) provided on halo section 92. In this manner, seat assembly 132 is biased by the halo section 92 against base 16 to cover and seal outlet opening 30*b*. In addition, levers 142 are biased outwardly from base 16 by the force of set screws 146 on lever bar ring 144 as it bears against seat assembly 132 and lever bar ring 144 pushes on levers 142 at a lower edge of lever channels 158 (see FIG. 20). That is, lever bar ring 144 contact levers 142 inwardly of retaining ridge 58 and outwardly of fusible plate engaging portions 150 which causes levers 142 to apply a tension force to fusible plate members 140*a* and 140*b* in an outwardly-planar direction. Thus, when fusible plate assembly 140 is exposed to temperatures associated with a fire and the fusible material between plate members 140*a* and 140*b* melts, levers 142 will urge plate members 140*a* and 140*b* to separate, and will further rotate about retaining ridge 58 and disengage from retaining ridge 58.

Figure 3A:
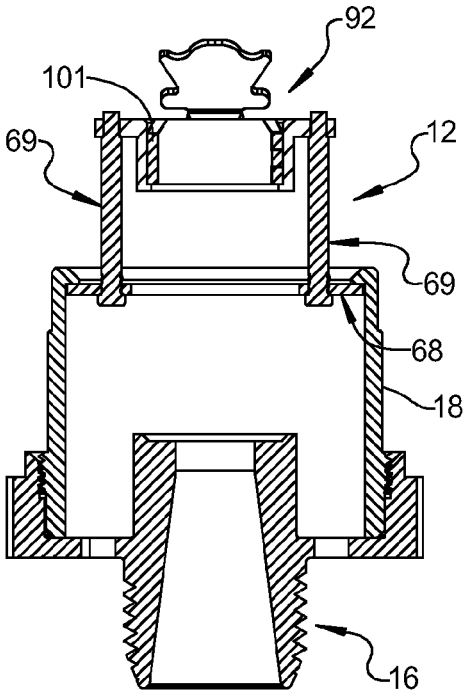
FIGS. 3A and 3B are cross-sectional views similar to FIG. 1, but showing the trigger assembly removed and the deployment assembly in an extended deployed position.
Figure 3B:
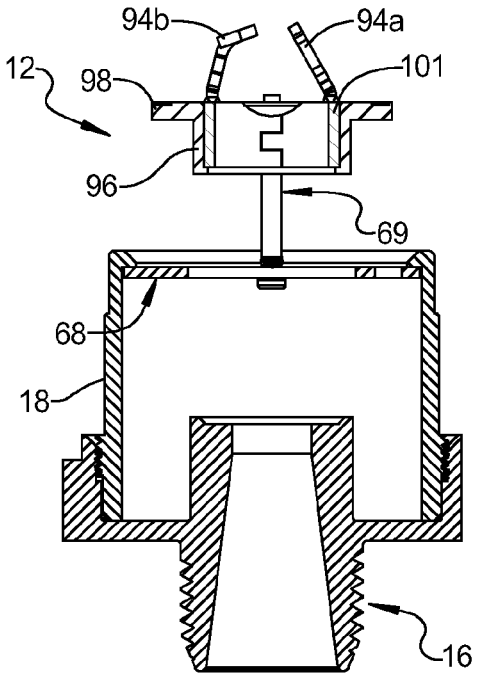

FIGS. 3A and 3B show the sprinkler assembly 10 in an activated condition with the thermal sensitive element assembly 14 removed and the deployment assembly 12 in its fully extended position and seat assembly 132 fully removed from the central passage 30.

Still further, in some embodiments as illustrated in FIGS. 3, 18, and 20, lever bar ring 144 can comprise a guide member aperture 166. Guide member aperture 166 can engage guide member 42 in a manner similar to that described herein to aid in assembly, minimizing binding movement of deployment assembly 12, and generally prevent rotational movement about axis Z-Z.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention. For example, a person of having ordinary skill in the art will readily understand that other trigger or fusible links or spring assemblies may be used with this sprinkler assembly and, further, that sprinkler bodies having varying internal components which differ from those depicted may employ the features of the present teachings.

What is claimed is:

1. A sprinkler assembly comprising:

a base including a passageway, an inlet opening communicating with a pressurized fluid source, an outlet opening for outputting a flow of pressurized fluid along a flow path, and an axis extending through said outlet opening;

a top extending from said base having a retaining ridge, said top and said base defining a cavity;

a deployment assembly supporting a flow shaper assembly, said deployment assembly movably mounted to at least one of the base and the top and being movable horizontally between a retracted position and an extended position for dispersing the pressurized fluid from said outlet opening; and a heat responsive trigger mounted to releasably retain said deployment assembly within said retracted position, said flow shaper assembly having at least one contact surface for shaping the flow of pressurized fluid from said outlet opening when said deployment assembly is in said extended position, wherein said flow shaper assembly includes an opening aligned along said axis extending through said outlet opening, said opening of said flow shaper assembly at least generally aligned along said flow path extending from said outlet opening along said axis, wherein fluid flows unimpeded through said opening of said flow shaper assembly, said flow shaper assembly having a flow shaper provided at said opening of said flow shaper assembly extending radially inward from a perimeter of said opening toward said axis.

2. The sprinkler assembly according to claim 1 wherein said deployment assembly is movable horizontally between said retracted position wherein at least a portion of said flow shaper is recessed within said cavity and said extended position wherein said flow shaper is spaced from said outlet opening for dispersing the pressurized fluid which flows from said outlet opening.

3. The sprinkler assembly according to claim 1 wherein said heat responsive trigger includes a pair of elements interconnected by heat fusible material, said heat fusible material melting upon exposure to temperatures associated with a fire, said heat responsive trigger applying a biasing force to urge said deployment assembly toward said retracted position and releasing said biasing force when said heat fusible material melts.

4. The sprinkler assembly according to claim 1 wherein said flow shaper comprises a tab member.

5. The sprinkler assembly according to claim 1 wherein said flow shaper comprises a plurality of tab members.

6. The sprinkler assembly according to claim 1 wherein said opening of said flow shaper assembly is at least as large as said outlet opening.

7. The sprinkler assembly according to claim 1 wherein said deployment assembly comprises:

a deflector ring slidably movable within said cavity;

at least one deflector pin extending between said deflector ring and said flow shaper assembly operably coupling said flow shaper assembly to said deflector ring for movement therewith.

8. The sprinkler assembly according to claim 7 wherein said deflector ring engages said retaining ridge of said top when said deployment assembly is in said extended position.

9. The sprinkler assembly according to claim 1, further comprising:

a seat assembly disposed between said outlet opening and said flow shaper assembly, said seat assembly sealingly engaging said outlet opening to generally inhibit flow of said pressurized fluid when said deployment assembly is in said retracted position.

10. The sprinkler assembly according to claim 9 wherein said seat assembly is removable from said outlet opening in response to said movement of said deployment assembly from said retracted position to said extended position.

11. The sprinkler assembly according to claim 1 wherein said flow shaper assembly comprises:

a halo portion having a central aperture; and a flow shaper disposed within said central aperture of said halo portion, said flow shaper defining said opening of said flow shaper assembly.

12. The sprinkler assembly according to claim 11 wherein said flow shaper comprises an annular member supported by said halo portion.

13. The sprinkler assembly according to claim 1, further comprising:

a guide member operably engaging at least one of said deployment assembly, said flow shaper assembly, and said heat responsive trigger to generally maintain axial alignment with said base when the sprinkler assembly is horizontally mounted.

14. A sprinkler assembly comprising:

a sprinkler base including a passageway, an inlet opening communicating with a pressurized fluid source, an outlet opening for outputting a flow of pressurized fluid along a flow path, and an axis extending through said outlet opening;

a deployment assembly supporting a flow shaper assembly, said deployment assembly movably mounted to the base and being movable between a retracted position and an extended position for dispersing the pressurized fluid from said outlet opening; and a heat responsive trigger mounted to releasably retain said deployment assembly within said retracted position, said flow shaper assembly having at least one contact surface for shaping the flow of pressurized fluid from said outlet opening when said deployment assembly is in said extended position, wherein said flow shaper assembly includes an opening aligned along said axis extending through said outlet opening, said opening of said flow shaper assembly at least generally aligned along said flow path extending from said outlet opening along said axis, wherein fluid flows unimpeded through said opening of said flow shaper assembly, said flow shaper assembly having a flow shaper provided at said opening of said flow shaper assembly extending radially inward from a perimeter of said opening toward said axis.

15. The sprinkler assembly according to claim 14 wherein said deployment assembly is movable between said retracted position and said extended position wherein said flow shaper is spaced from said outlet opening for dispersing the pressurized fluid which flows from said outlet opening.

16. The sprinkler assembly according to claim 14 wherein said heat responsive trigger includes a pair of elements interconnected by heat fusible material, said heat fusible material melting upon exposure to temperatures associated with a fire, said heat responsive trigger applying a biasing force to urge said deployment assembly toward said retracted position and releasing said biasing force when said heat fusible material melts.

17. The sprinkler assembly according to claim 14 wherein said flow shaper comprises a tab member.

18. The sprinkler assembly according to claim 14 wherein said flow shaper comprises a plurality of tab members.

19. The sprinkler assembly according to claim 14 wherein said opening of said flow shaper assembly is at least as large as said outlet opening.

20. The sprinkler assembly according to claim 14 wherein said deployment assembly comprises:

a deflector ring slidably movable within a cavity of said sprinkler body;

at least one deflector pin extending between said deflector ring and said flow shaper assembly operably coupling said flow shaper assembly to said deflector ring for movement therewith.

21. The sprinkler assembly according to claim 20 wherein said deflector ring engages a retaining ridge of said sprinkler body when said deployment assembly is in said extended position.

22. The sprinkler assembly according to claim 14, further comprising:

a seat assembly disposed between said outlet opening and said flow shaper assembly, said seat assembly sealingly engaging said outlet opening to generally inhibit flow of said pressurized fluid when said deployment assembly is in said retracted position.

23. The sprinkler assembly according to claim 22 wherein said seat assembly is removable in response to said movement of said deployment assembly from said retracted position to said extended position.

24. The sprinkler assembly according to claim 14 wherein said flow shaper assembly comprises:

a halo portion having a central aperture; and a flow shaper disposed within said central aperture of said halo portion, said flow shaper defining said opening of said flow shaper assembly.

25. The sprinkler assembly according to claim 24 wherein said flow shaper comprises an annular member supported by said halo portion.

26. The sprinkler assembly according to claim 14, further comprising:

a guide member operably engaging at least one of said deployment assembly, said flow shaper assembly, and said heat responsive trigger to generally maintain axial alignment with said base when the sprinkler assembly is horizontally mounted.

27. A sprinkler assembly comprising:

a sprinkler base including a passageway, an inlet opening communicating with a pressurized fluid source, an outlet opening for outputting a flow of pressurized fluid along a flow path, and an axis extending through said outlet opening;

a deployment assembly supporting a flow shaper assembly, said deployment assembly movably mounted to the base and being movable between a retracted position and an extended position for dispersing the pressurized fluid from said outlet opening; and a heat responsive trigger mounted to releasably retain said deployment assembly within said retracted position, said flow shaper assembly having at least one contact surface for shaping the flow of pressurized fluid from said outlet opening when said deployment assembly is in said extended position, wherein said flow shaper assembly includes an opening aligned along said axis extending through said outlet opening, said opening of said flow shaper assembly at least generally aligned along said flow path extending from said outlet opening along said axis, said flow shaper assembly having a flow shaper provided at said opening of said flow shaper assembly extending radially inward from a perimeter of said opening toward said axis, a guide member operably engaging at least one of said deployment assembly and said flow shaper assembly to generally maintain axial alignment with said base when the sprinkler assembly is horizontally mounted.

28. The sprinkler assembly according to claim 27, wherein said guide member is elongated and extends axially from said sprinkler base parallel to said axis of said outlet opening.

* * * * *